US006007271A

United States Patent [19]

Cole et al.

[11] Patent Number: 6,007,271

[45] Date of Patent: Dec. 28, 1999

[54] GROUND PRESSURE DISTRIBUTION MAT AND METHOD OF USE

[75] Inventors: Michael E. Cole, Geneva; Alvie G. Green, Dellroy; Daniel L. Pikna, Mineral City, all of Ohio

[73] Assignee: American Landfill Management, Inc., Warren, Ohio

[21] Appl. No.: 09/149,715

[22] Filed: Sep. 9, 1998

[51] Int. Cl.[6] ..... E01C 5/16

[52] U.S. Cl. ..... 404/35; 404/19; 52/125.2

[58] Field of Search ..... 404/35, 19, 36; 52/125.2, 177, 664

[56] References Cited

U.S. PATENT DOCUMENTS

| | | | |
|---|---|---|---|
| 937,415 | 10/1909 | Cairns | 404/19 |
| 2,315,448 | 3/1943 | Nagin et al. | 404/36 |
| 2,327,640 | 8/1943 | Hendry | 404/36 |
| 2,335,556 | 11/1943 | Wilson | 404/36 |
| 2,373,698 | 4/1945 | McGerary et al. | 404/35 |
| 2,375,454 | 5/1945 | Wichert | 404/36 |
| 2,404,097 | 7/1946 | Ruppel | 404/36 |
| 2,826,970 | 3/1958 | Greulich | 404/36 |
| 2,912,909 | 11/1959 | Hart | 404/36 |
| 3,093,216 | 6/1963 | Dunham | 404/19 |
| 3,315,577 | 4/1967 | Box | 404/35 |
| 3,319,543 | 5/1967 | Braeuninger et al. | 404/35 |
| 3,913,291 | 10/1975 | Dulien et al. | 404/36 |
| 4,364,539 | 12/1982 | Drysdale . | |
| 4,376,596 | 3/1983 | Green . | |
| 4,488,833 | 12/1984 | Perry et al. . | |
| 4,648,219 | 3/1987 | Johnston, Sr. . | |
| 4,875,800 | 10/1989 | Hicks | 404/35 |
| 4,889,444 | 12/1989 | Pouyer | 404/36 |
| 4,917,532 | 4/1990 | Haberhauer et al. | 404/35 |
| 4,973,193 | 11/1990 | Watson et al. | 404/37 |
| 5,087,149 | 2/1992 | Waller, Jr. | 404/35 |
| 5,201,601 | 4/1993 | Stanley et al. | 404/35 |
| 5,364,204 | 11/1994 | MacLeod | 404/35 |
| 5,366,224 | 11/1994 | Stanwyck et al. | 404/35 |
| 5,383,742 | 1/1995 | Grace . | |
| 5,527,128 | 6/1996 | Rope et al. | 404/35 |
| 5,653,551 | 8/1997 | Seaux . | |

FOREIGN PATENT DOCUMENTS

| | | |
|---|---|---|
| 992640 | 6/1980 | U.S.S.R. . |

*Primary Examiner*—Thomas B. Will
*Assistant Examiner*—Krishie Markovich
*Attorney, Agent, or Firm*—Robert J. Herberger, Esq.

[57] ABSTRACT

A mat is used as a ground engagement platform for supporting heavy equipment or as a road surface for supporting vehicular traffic. The use is intended to be temporary, with the mats being reusable. The mat, in its basic construction, includes a flat plate-like structure having a thickness and planar extent and an opening defined in the flat plate-like structure which extends in the thickness direction and is dimensioned to receive a lifting device for lifting and transporting the mat.

27 Claims, 5 Drawing Sheets

GROUND PRESSURE DISTRIBUTION MAT AND METHOD OF USE

1. TECHNICAL FIELD

This invention relates to a specialized mat used as a ground engaging platform for supporting heavy equipment, or to a mat used as a road surface for supporting vehicular traffic. Both uses are intended to be temporary, with the mats being reusable.

2. BACKGROUND DISCUSSION

Mats are used as a platform and/or as a road surface. Mat configurations vary in size and shape. Some mats are discrete units, which when assembled form the platform and/or the road surface. The most common configuration comprises a series of logs attached laterally by cables, bar stock or ropes. FIG. 1 shows such a configuration. The logs 1 are connected by cables, bar stock or ropes 2. A transport cable or rope 3 is provided for positioning the assembled logs.

The discrete unit configuration is popular as it is readily adaptable to many situations. Terrain and work conditions may vary widely [i.e., mud versus rocks and/or soft soil, hills, valleys, short versus long traverses with various widths in the platform or road, etc . . . ]. Therefore, the discrete unit configuration is more adaptable than other configurations, such as the surfacing or the track-way system described in U.S. Pat. No. 4,488,833 issued to Perry, et al., showing a plurality of rectangular planks joined to each other by hinge members so that the system may be stored by folding the planks in an accordion fashion. The discrete unit configuration has an individual, modular-like capability, making it more versatile and more easily changeable to meet the many unique terrain and surface conditions.

In the past, the most desirable material used for constructing discrete unit configuration mats has been wood since it is readily available and is easy to work with. Other materials have been introduced, but, these are more difficult to handle when forming the desired configuration. Durability is also an important consideration. With mats made of wood, the problem of durability becomes especially acute because over time the wood is subject to deterioration due to weather and other environmental conditions. This adverse effect can be somewhat mitigated by specially treating the wood. However, this adds considerably to the cost of fabricating the mats. Additionally, the mats are easily cracked and gouged by the steel tracks of the equipment using them.

Since these mats are often somewhat large in dimension [some averaging up to 40 feet by 10 feet], heavy lifting and moving equipment is typically necessary to transport and then arrange the mat at the site where it is to be used. Also, since construction of the mat at the site where it is to be used is practically impossible, transporting the mat to the site is a factor which must be addressed.

Prior discrete mat inventions require manual labor to some extent when they are being moved and arranged. Typically, workers must physically attach a cable or other pulling mechanism from the mat to the moving equipment, creating an unsafe working condition. The attached cable may break causing a lifted mat to fall, damaging or possibly destroying the mat and anything in its path.

It would be desirable, therefore, to have a mat which possesses a number of capabilities, one of which is that each mat should be readily transportable in a safe manner from the fabrication site to the use site, and then easily and safely arranged in assembly with other mats to form the completed platform and/or road surface. Also, the mat must be made of durable material, capable of withstanding the heavy loads required by its use as a platform and/or road surface. It should also be capable of being made of material which is not significantly impacted by environmental conditions and is relatively inexpensive to fabricate.

SUMMARY OF THE INVENTION

An object of the invention is to provide the existing state-of-the-art with a mat which satisfies the desired capabilities noted above.

The mat need be nothing more than a plate-like structure having a planar extent and a thickness, the thickness being less than the planar extent. The mat in this invention further comprising an opening defined in the thickness direction. The opening is dimensioned so that it can receive a lifting device, such as the front end of an excavator bucket. With this invention, the operator of the excavator can use the excavator bucket to safely, easily and efficiently move and arrange each mat at the work site without direct manual intervention.

The mat can be constructed to include elongated beam members and a top plate connected to the beam members. An opening is defined through the top plate and traverses through the beam members. The opening serves to receive a lifting device, such as the bucket of an excavator, for lifting, transporting and placing the mat safely and efficiently at the use site.

The mat may also include stiffener members which extend transversely of the beam members, a channel member at each longitudinal end of the beam members, and a bottom plate with an opening being registerably aligned with the opening in the top plate so that an excavator bucket may pass therethrough. The top plate may include a non-skid diamond pattern over substantially its entire planar extent. The top plate may also include anti-skid cleats and lateral skid retaining bars extending over part of the planar extent with, or without, the non-skid diamond pattern.

BRIEF DESCRIPTION OF THE DRAWINGS

Six figures have been selected to illustrate the present invention. It is believed that those skilled in the art when considering these figures and the ensuing description will be sufficiently advised to practice the invention.

DESCRIPTION OF THE PREFERRED EMBODIMENT

Generally

Figure 1:
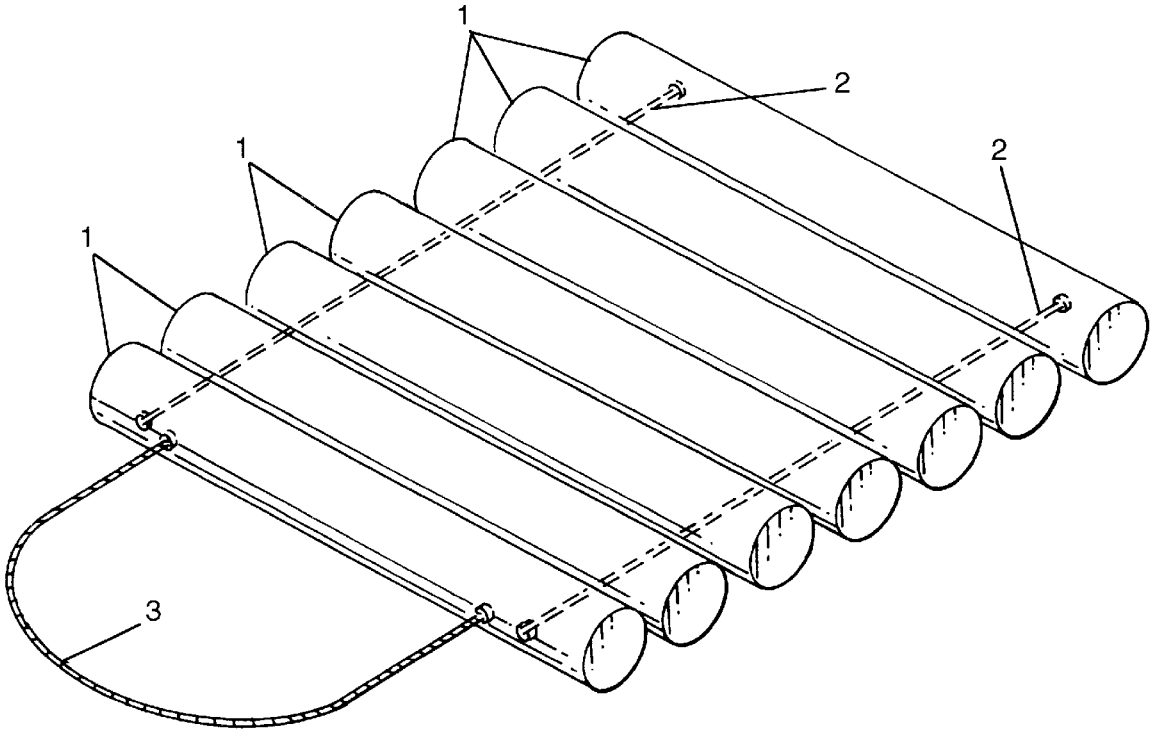
FIG. 1 PRIOR ART
FIG. 1 illustrates an example of a known mat made from wood logs.
Figure 2:
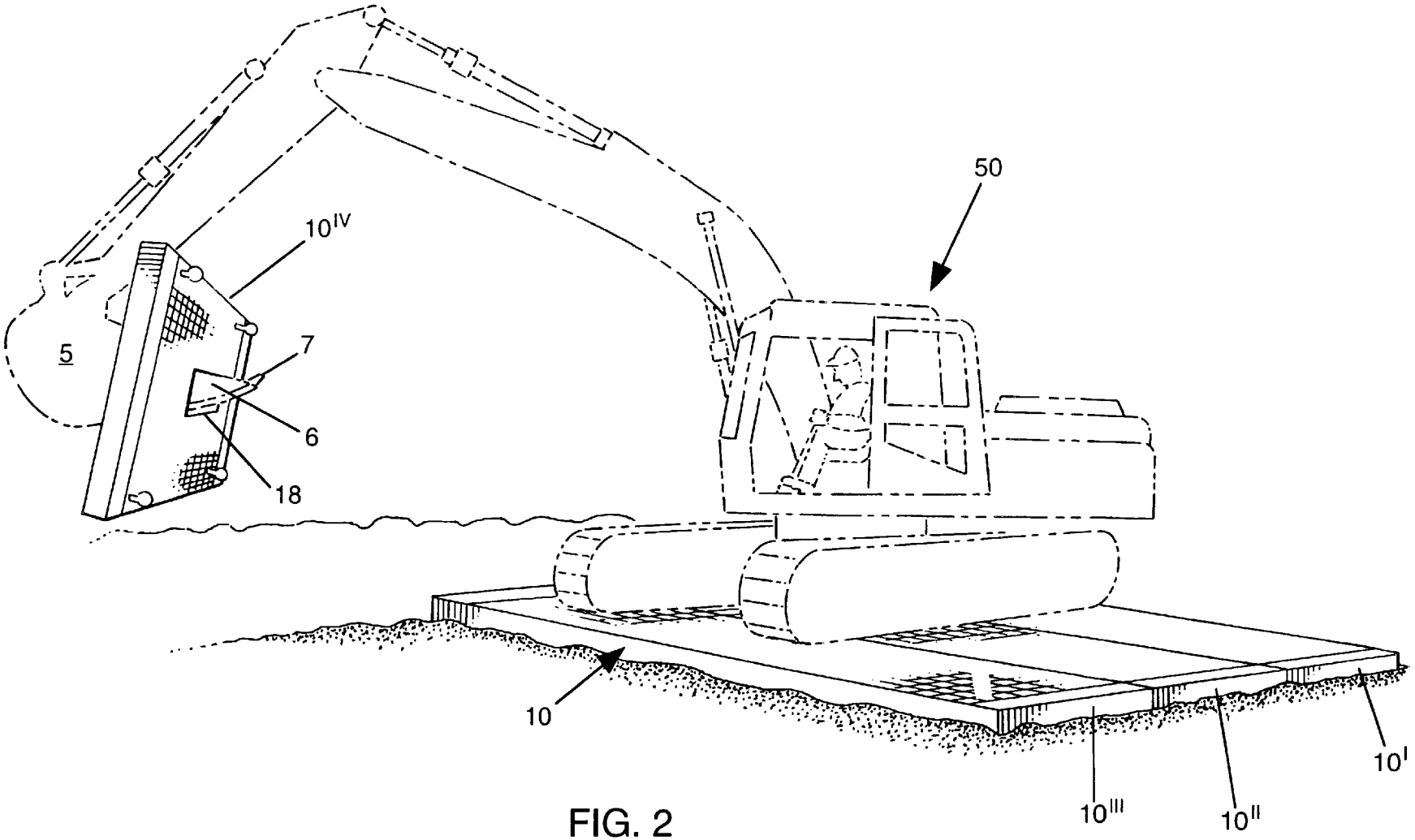
FIG. 2 illustrates a mat according to the present invention being positioned in assembly with other mats by an excavator widely used in the construction industry.

The mat according to the present invention is preferably constructed of durable material such as aluminum or steel. The construction essentially comprises a square or rectangular shape having a series of intersecting beam members forming a rigid frame structure and a top plate having an upper surface. The top plate and frame structure also define an opening which is dimensioned to receive the front end of an excavator bucket as shown in FIG. 2. A bucket of similar construction equipment such as a backhoe or front-end loader may also be used.

In addition, the mat may be provided with components which are removable and which would be useful as an alternative when lifting or hoisting the mat onto, for example, a flatbed truck for transport.

Specifically

Referring to FIGS. 2–6, a specific preferred embodiment is illustrated. A mat 10 is shown having the construction illustrated in FIGS. 3–6. FIG. 2 shows a piece of heavy equipment, an excavator 50 with a bucket 5 including a front end 6 with teeth 7. In FIG. 2, a platform is shown, or the beginning of a road surface on which the excavator 50 is supported. The excavator 50 is shown as lifting and balancing the mat 10 with its bucket 5. Note that the front end 6 of the bucket 5 extends through an opening 18 defined substantially in the center of the mat 10. The excavator 50 has lifted the mat 10 from a storage area (not shown) and is transporting it to arrange it into assembly with already assembled mats 10', 10" and 10'". The mat being transported will form mat $\mathbf{10}^{iv}$ of the assembly.

Figure 3:
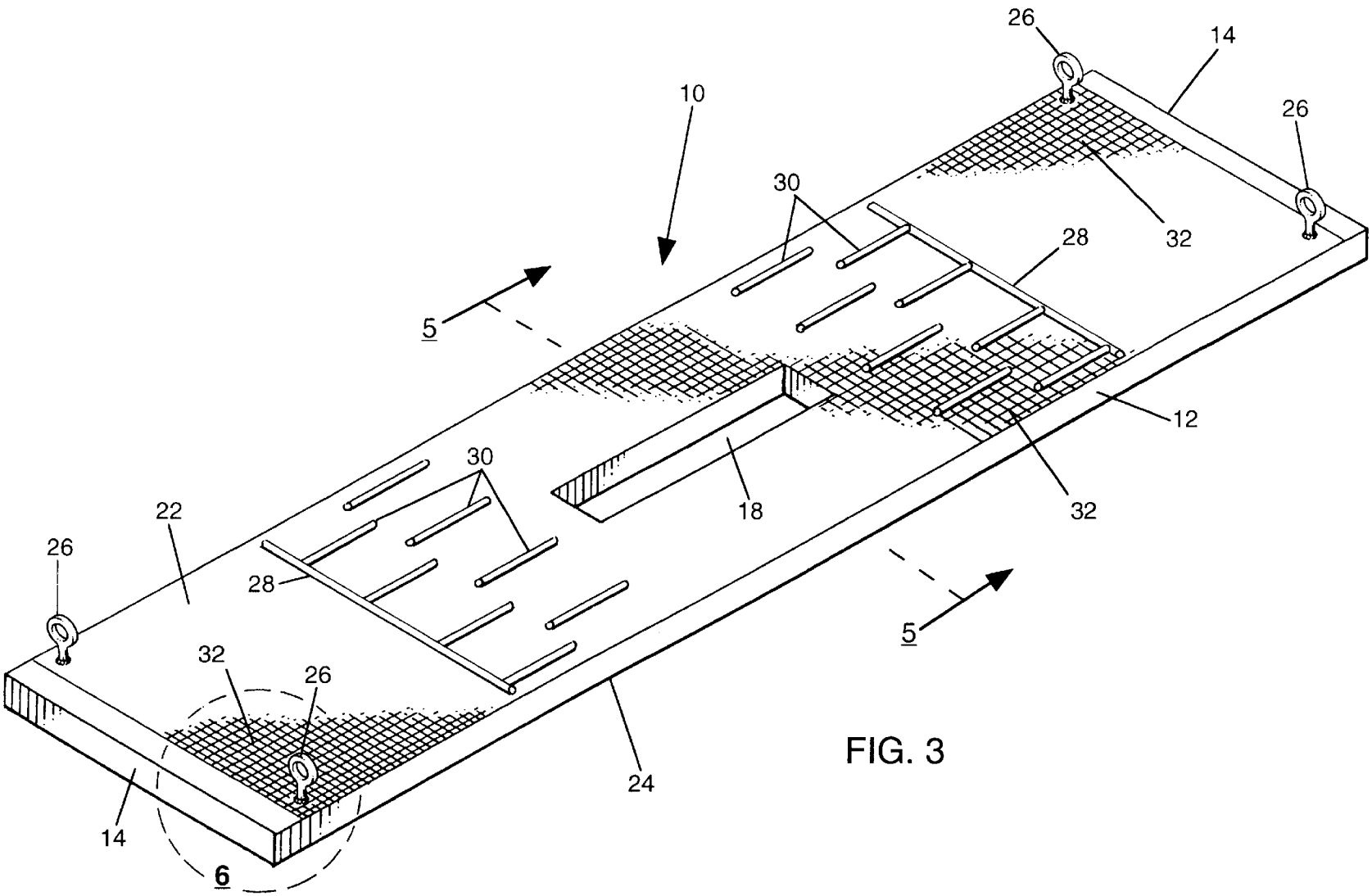
FIG. 3 is a perspective view of the mat according to the present invention.
Figure 4:
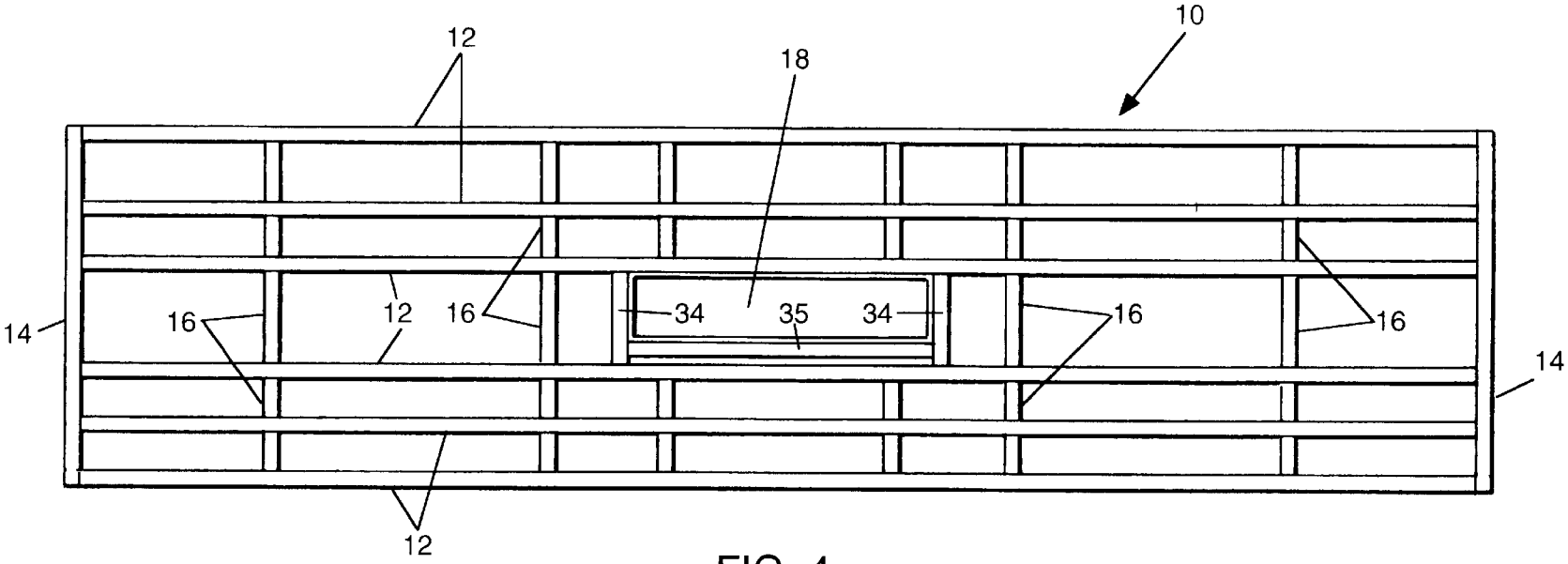
FIG. 4 is a plan view of the mat showing the beam, stiffener and channel members according to the present invention.
Figure 5:
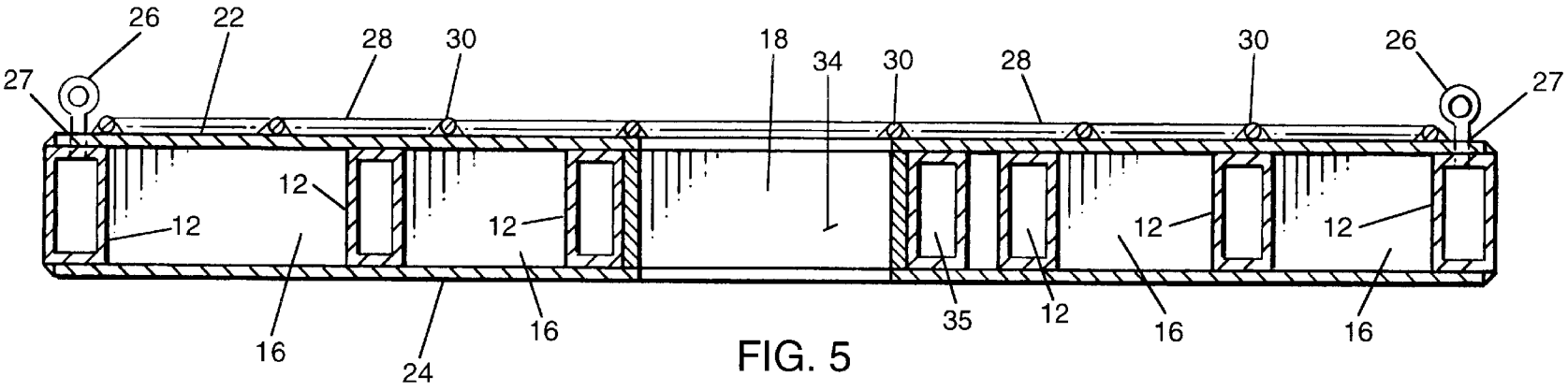
FIG. 5 is a cross-sectional enlarged view of the mat in FIG. 3 taken along line 5—5 of FIG. 3.
Figure 6:
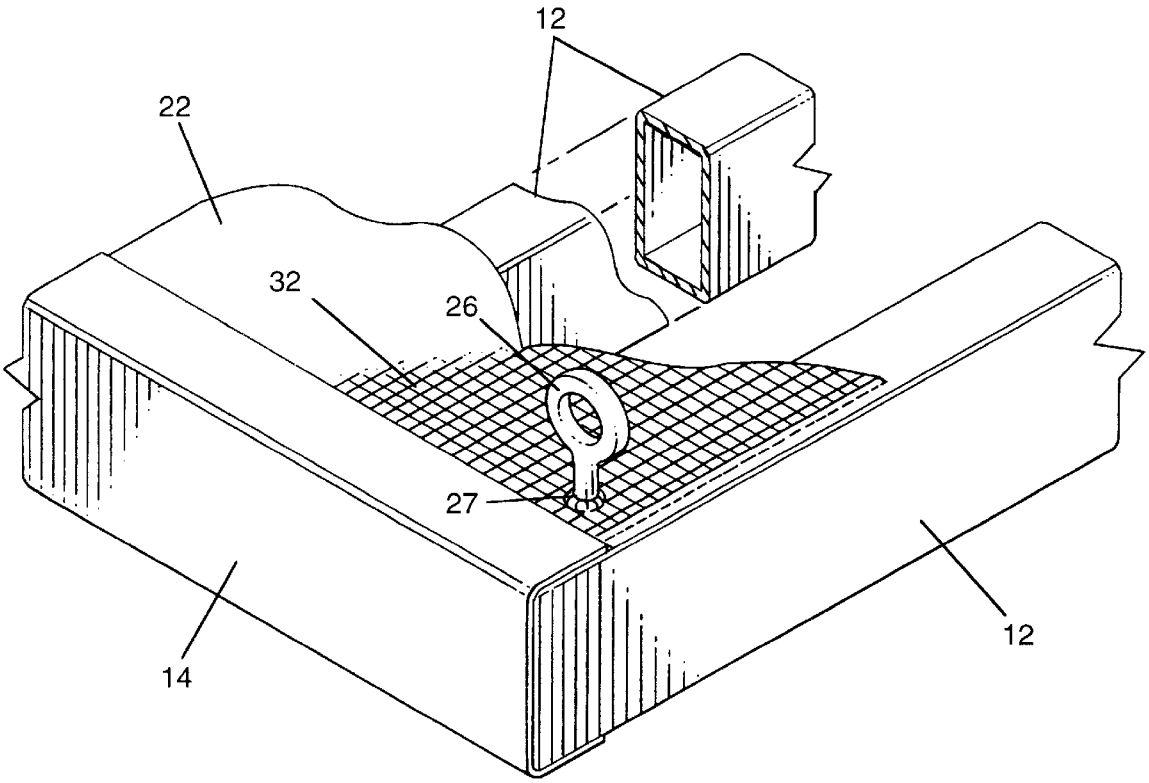
FIG. 6 is a partial isometric view of a corner of the mat according to the present invention.

The mat 10 has a discrete structural unit as shown in FIGS. 3–6. Turning first to FIG. 4, there is shown the mat 10 which comprises a plurality of longitudinally extending beam members 12, transversely extending channel members 14 and transversely extending stiffener members 16. The channel members 14 receive the longitudinal ends of the beam members 12, as best seen in FIGS. 4 and 6. The stiffener members 16 are formed into parallel rolls as shown in FIG. 4, and extend between adjacent beam members 12. Of course it is not necessary that each roll of stiffener members 16 be continuous. The determining factor being the material used, the size of the members being used and the use to be made of the mat. For example, if it is intended for heavy track equipment, such as track drilling equipment, excavators or loaders, the configuration shown in FIG. 4 might be desirable. On the other hand, if the equipment is not as large or if the mat is intended for use on a road surface for handling the movement of small vehicles, then the number of stiffener members 16 can be reduced. In fact, this also applies to the number of beam members 12.

Viewing FIG. 5, the mat 10 is preferably provided with a top plate 22 mounted on one side of the beam members 12. In the preferred embodiment, a bottom plate 24 is mounted on the opposite side of beam members 12, as shown. Opening 18 is formed in the mat 10 in the thickness direction, supported by lateral and longitudinal frame members 34 and 35, respectively, along with one of the beam members as shown in FIGS. 4 and 5. It is only necessary to dimension the size of the opening 18 so that it can receive the front end 6 of an excavator bucket 5, or any equivalent equipment bucket that could be used for lifting and moving the mat 10 as shown in FIG. 2. Opening 18 must be large enough to receive the bucket 5 of the excavator 50 so that the teeth 7 of the bucket 5 can firmly engage the bottom plate 24, or the underside of mat 10 if a bottom plate is not used.

The top plate 22 has, preferably, a non-skid diamond pattern 32 formed in the upper surface of the top plate or applied to the upper surface of the top plate as seen in FIGS. 3 and 6. In addition, one or more rolls of anti-skid cleats 30 and lateral skid retaining bars 28 may be provided on the non-skid diamond pattern 32. The non-skid features of the present invention are intended to improve traction and ensure safety when using the mat 10, especially with vehicles or equipment having a track.

An eye-bolt 26 may be provided at each of the four corners as shown in FIG. 3, or any other location along the frame. The eye-bolts 26 are removably secured to the mat 10 at treaded holes 27, best shown in FIG. 6. These eye-bolts 26 can be used for hoisting the mat 10 onto, for example, a flatbed truck for transporting the mat 10 from the fabrication or storage site to the use site. They can also be used to remove the mats 10 from the transporting vehicle at the use site and even to place the mats 10 in assembly if other lifting equipment, such as an excavator, is not available.

The beam members 12, as well as the stiffener members 16 can be box-shaped, as shown in FIGS. 5 and 6. Of course, any desired shape is possible.

The beam members 12, stiffener members 16, channel members 14, bottom plate 24 and top plate 22 can be fabricated of wood or preferably some metal, such as aluminum or steel, or even plastic. In the case of wood or plastic, the individual members can be assembled into a discrete unit by using screws or an adhesive. In the case of metal, the assembly can be achieved by, for example, welding.

A single plate is shown in the figures to form the top plate 22 and a single plate may be used to form the bottom plate 24, However, a plurality of plates can be assembled and welded together to form the top plate 22, as well as the bottom plate 24 in a similar manner. The only requirement is that the opening 18 be formed essentially as shown, either through one or more of the plurality of plates forming the top plate 22 and bottom plate 24.

The mat 10, according to the present invention, when constructed is very adaptable for use alone or in assembly with other mats. The assembled mats can be any size to accommodate light or heavy equipment, or to form a road surface. As discussed herein, some advantages of the mats according to the present invention are that they are reusable, reversible, easily and more safely transportable at the work site, safer and more efficient to lift and place and have the structural strength to support and absorb significant loads.

What is claimed is:

1. A mat serving as a ground engaging platform, comprising:

a flat plate-like structure having at least three sides, a thickness and planar extent and defining an opening therethrough in the thickness direction, said opening being located within the plate-like structure and lateral to and substantially in the middle of at least one of the sides, said opening being dimensioned to receive the front end of a bucket of an excavating apparatus in order to lift and transport said mat, and a lift support member at a perimeter of said opening to support the weight of the mat as the mat is being lifted and transported by said excavating apparatus.

2. The mat as defined in claim 1, wherein said flat plate-like structure includes a plurality of elongated, spaced apart beam members, and a top plate situated on one side of said beam members, said opening extending through said top plate.

3. The mat as defined in claim 1, wherein said flat plate-like structure includes a top plate having an upper surface, said upper surface having a plurality of anti-skid cleats.

4. The mat as defined in claim 2, wherein said flat plate-like structure further includes a plurality of stiffener members extending transversely with respect to said beam members, forming spaced apart rows of stiffener members.

5. The mat as defined in claim 2, wherein said flat plate-like structure further includes a channel member positioned at each longitudinal end of said plurality of beam members.

6. The mat as defined in claim 2, wherein said flat plate-like structure includes a plurality of plates forming said top plate, each situated in an abutting manner on one edge of said beam members.

7. The mat as defined in claim 2, wherein said top plate has an upper surface, and wherein said upper surface includes a non-skid diamond pattern.

8. The mat as defined in claim 4, wherein said flat plate-like structure further includes a channel member positioned at each longitudinal end of said plurality of beam members.

9. The mat as defined in claim 6, wherein each plate of said top plate has an upper surface, and wherein at least one of said plates includes a non-skid diamond pattern on its upper surface, and the mat further comprises a plurality of anti-skid cleats and a lateral skid retaining bar.

10. The mat as defined in claim 7, wherein said top plate includes a plurality of anti-skid cleats.

11. The mat as defined in claim 7, wherein said top plate includes a lateral skid retaining bar.

12. A mat serving as a ground engaging platform, comprising:

a plurality of elongated, spaced apart beam members; and a top plate having at least three sides and defining an opening therethrough, said top plate being situated on one side of said beam members, said opening being lateral to and substantially in the middle of at least one of the sides, a lift support member at a perimeter of the opening, said opening serving to receive an excavating apparatus having a bucket with teeth for lifting and moving said mat, and the opening being dimensioned large enough to receive the bucket so that the teeth of the bucket can firmly engage the mat for lifting by said excavating apparatus.

13. The mat as defined in claim 12, further comprising:

a plurality of stiffener members extending transversely with respect to said beam members, forming spaced apart rows of stiffener members.

14. The mat as defined in claim 12, further comprising:

a channel member positioned at each longitudinal end of said plurality of beam members.

15. The mat as defined in claim 12, wherein a plurality of plates comprise said top plate, each plate situated in an abutting manner on one side of said beam members, with at least one of said plates defining said opening through said top plate.

16. The mat as defined in claim 12, wherein said top plate has an upper surface, and wherein said top plate includes a non-skid diamond pattern extending over the upper surface.

17. A method of lifting and moving a mat serving as a ground engaging platform, which comprises:

guiding a bucket of an excavating apparatus into an opening of the mat, the mat comprising a flat plate-like structure, a thickness and planar extent, said opening being through the flat plate-like structure in the thickness direction and said opening being dimensioned to receive the front end of said bucket;

firmly engaging said mat with said bucket through said opening; and lifting and moving said engaged mat using the excavating apparatus.

18. The method of claim 17, wherein the mat has at least three sides and said opening is located substantially in the middle of at least one of the sides.

19. The method of claim 17, wherein said plate-like structure includes a plurality of elongated, spaced apart beam members, and a top plate situated on one side of said beam members, said opening extending through said top plate.

20. The method of claim 17, wherein said mat further includes a top plate with the opening extending therethrough, and a lifting support member at a perimeter of said opening to support the weight of the mat as the mat is being lifted by said excavating apparatus.

21. The method of claim 20, wherein the lifting support member is a frame around said opening.

22. A method of lifting and moving a mat serving as a ground engaging platform, which comprises:

guiding a bucket of an excavating apparatus through an opening in said mat, the mat comprising a top plate and at least three sides, the opening in the mat being defined through said top plate, said opening being lateral to and substantially in the middle of at least one of the sides, and the opening being dimensioned large enough to receive the bucket;

engaging the mat with said bucket through said opening; and lifting and moving said engaged mat by manipulating said excavating apparatus.

23. The method of claim 22, wherein the mat further includes a plurality of plates comprising said top plate with at least one of said plates defining said opening through said top plate, and each plate situated in an abutting manner on one side of a plurality of beam members.

24. The method of claim 22, wherein the mat further comprises a lifting support member at a perimeter of said opening to support the weight of the mat against the engaging bucket as the mat is being lifted by said excavating apparatus.

25. The method of claim 23, wherein each plate of said top plate has an upper surface, and wherein at least one of said plates includes a non-skid diamond pattern extending over at least part of the upper surface of said plate, and the mat further comprising a plurality of anti-skid cleats and a lateral skid retaining bar.

26. The method of claim 23, wherein at least one of said plates of the top plate includes a plurality of anti-skid cleats.

27. The method of claim 24, wherein the lifting support member is a frame around said opening.

* * * * *